US008869426B2

(12) United States Patent
Lorenzi et al.

(10) Patent No.: US 8,869,426 B2
(45) Date of Patent: Oct. 28, 2014

(54) HEATING CIRCUIT WITH MONITORING ARRANGEMENT FOR A HOUSEHOLD APPLIANCE

(75) Inventors: Marco Lorenzi, Porcia (IT); Paolo Driussi, Zoppola (IT)

(73) Assignee: Electrolux Home Products Corporation N.V., Brussels (BE)

( * ) Notice: Subject to any disclaimer, the term of this patent is extended or adjusted under 35 U.S.C. 154(b) by 167 days.

(21) Appl. No.: 13/697,838

(22) PCT Filed: May 12, 2011

(86) PCT No.: PCT/EP2011/057712
§ 371 (c)(1),
(2), (4) Date: Nov. 14, 2012

(87) PCT Pub. No.: WO2011/141555

PCT Pub. Date: Nov. 17, 2011

(65) Prior Publication Data

US 2013/0061488 A1 Mar. 14, 2013

(30) Foreign Application Priority Data

May 14, 2010 (EP) ..... 10162838

(51) Int. Cl.
*D06F 33/02* (2006.01)
*D06F 58/26* (2006.01)
*D06F 39/04* (2006.01)
*D06F 25/00* (2006.01)

(52) U.S. Cl.
CPC ..... *D06F 58/26* (2013.01); *D06F 39/04* (2013.01); *D06F 25/00* (2013.01); *D06F 33/02* (2013.01)
USPC ..... 34/528; 34/531; 34/535; 34/552; 219/507; 219/509; 134/58 R; 68/20; 392/486; 374/183; 307/651

(58) Field of Classification Search
USPC ..... 34/493, 507, 528, 532, 535, 552, 89; 219/507, 509; 134/58 R; 68/8 C, 19, 20; 392/466, 486; 374/141, 183; 307/651
See application file for complete search history.

(56) References Cited

U.S. PATENT DOCUMENTS 2,851,790 A * 9/1958 Worst ..... 34/553
3,112,187 A * 11/1963 Stone ..... 34/527

(Continued)

FOREIGN PATENT DOCUMENTS

EP 0 924 331 6/1999
EP 1 744 248 1/2007

(Continued)

OTHER PUBLICATIONS

International Search Report issued in corresponding International Application No. PCT/EP2011/0057712, dated Sep. 13, 2011.

(Continued)

*Primary Examiner* — Steve M Gravini
(74) *Attorney, Agent, or Firm* — Banner & Witcoff, Ltd.

(57) ABSTRACT

A washing and/or drying appliance includes a heating circuit (140) for heating a washing liquid and/or a drying air flow, connected to voltage distribution lines (105*a*,105*b*) distributing power inside the appliance. The heating circuit includes at least one heating resistor (205) in series to switch means (210*a*,210*b*) controlled by an appliance control unit (125) for selectively energizing the heating resistor when required. The switch means of the heating circuit includes a first and a second switch (210*a*,210*b*) in series to the heating resistor, the heating resistor being interposed between the first and second switches. A monitoring circuit arrangement is provided, which includes a first resistor (R1) in shunt to the heating resistor and having a resistance substantially higher than that of the heating resistor, and a pull-up network connected between a first terminal (215*b*;215*a*) of the heating resistor and one of the voltage distribution lines. The control unit is configured for receiving a voltage corresponding to an electric potential at a second terminal (215*a*;215*b*) of the heating resistor.

12 Claims, 2 Drawing Sheets

(56) References Cited

U.S. PATENT DOCUMENTS

| | | | | | |
|---|---|---|---|---|---|
| 3,180,038 | A | * | 4/1965 | Chafee, Jr. | 34/533 |
| 3,409,994 | A | * | 11/1968 | Menk | 34/499 |
| 3,475,830 | A | * | 11/1969 | Botts et al. | 34/533 |
| 3,609,873 | A | * | 10/1971 | Odle, Jr. et al. | 4/549 |
| 3,942,265 | A | * | 3/1976 | Sisler et al. | 34/527 |
| 4,019,259 | A | * | 4/1977 | Veraart | 34/550 |
| 4,083,118 | A | | 4/1978 | Cotton | |
| 4,208,890 | A | | 6/1980 | Wood | |
| 4,642,907 | A | | 2/1987 | Best | |
| 5,564,831 | A | | 10/1996 | Bashark | |
| 6,064,043 | A | * | 5/2000 | Livers et al. | 219/492 |
| 6,079,121 | A | * | 6/2000 | Khadkikar et al. | 34/528 |
| 6,246,831 | B1 | | 6/2001 | Seitz et al. | |
| 7,594,343 | B2 | * | 9/2009 | Woerdehoff et al. | 34/491 |
| 8,015,726 | B2 | * | 9/2011 | Carow et al. | 34/381 |
| 2013/0061488 | A1 | * | 3/2013 | Lorenzi et al. | 34/89 |
| 2013/0119047 | A1 | * | 5/2013 | Driussi et al. | 219/507 |
| 2013/0126517 | A1 | * | 5/2013 | Driussi et al. | 219/509 |

FOREIGN PATENT DOCUMENTS

| | | |
|---|---|---|
| EP | 2 085 836 | 8/2009 |
| JP | 09 024197 | 1/1997 |

OTHER PUBLICATIONS

European Search Report issued in corresponding European Application No. 10162838.6 dated Nov. 9, 2010.

International Search Report dated Aug. 19, 2011 in International Application No. PCT/EP2011/057674 corresponding to related U.S. Appl. No. 13/697,832.

Italian Search Report and Opinion dated Jan. 26, 2011 in Italian Application No. MI2010A000862 corresponding to related U.S. Appl. No. 13/697,832.

International Search Report mailed Sep. 9, 2011 in International Application No. PCT/EP2011/056531 corresponding to related U.S. Appl. No. 13/697,835.

European Search Report dated Nov. 17, 2010 in European Application No. 10162839.4 corresponding to related U.S. Appl. No. 13/697,835.

* cited by examiner

HEATING CIRCUIT WITH MONITORING ARRANGEMENT FOR A HOUSEHOLD APPLIANCE

BACKGROUND OF THE INVENTION

The present invention relates in general to the field of household appliances, and more particularly to a heating circuit with monitoring arrangement for appliances like laundry washers, combined washers&dryers, dryers, dishwashers and the like, and in general for all those appliances wherein there is the necessity of heating a fluid (a washing liquid like in laundry washing machines or in dishwashers, or drying air like in laundry dryers).

Heating circuits for household appliances like those listed above generally comprise a heating element consisting of a heating resistor and a switch element (e.g. a relay commanded by an appliance control unit or a level switch which closes only when a sufficient amount of liquid is present in the washing tub to ensure that the heating resistor is immersed) for energizing the heating resistor when required, for example in order to heat the washing liquid for washing laundry or dishes, or to heat the air flow used to dry the laundry.

The heating circuit is generally monitored for assessing the proper operation and detecting possible faults thereof. Faults may as a matter of fact occur in the heating resistor or in the switch element energizing it. Usually, the heating circuit is monitored to identify whether the heating resistor is power on or off, or it is short-circuited to earth. Some of these faults may be extremely dangerous, for the appliance and even more for the user. For example, overheating of the heating resistor should be prevented, not to cause component parts to be damaged or destroyed, and fires to be produced; also, a heating resistor that occurs to be short-circuit to earth is a source of danger, because dispersion currents may reach the appliance cabinet and cause electrical shocks to the user. In case a fault of this type is detected, a decision is to be taken to halt the appliance.

The Applicant has observed that known monitoring arrangements of the heating circuit are not capable of discriminating among different types of faults. Some faults may be classified as dangerous for the user's safety and thus lead to the appliance halt even if, actually, there would be no risk and the machine operation could be continued. This is undesirable, because the user has to wait for the intervention of the service personnel.

SUMMARY OF SELECTED INVENTIVE ASPECTS

In view of the state of the art outlined above, it has been an object of the present invention to devise an improved heating circuit arrangement for a household appliance that guarantees a full monitoring and discrimination of essentially every possible fault.

According to an aspect of the present invention, there is provided a washing and/or drying appliance, comprising a heating circuit for heating a washing liquid and/or a drying air flow, the heating circuit being connected to (AC) voltage distribution lines distributing (AC) power inside the appliance and comprising at least one heating resistor in series to switch means controlled by an appliance control unit for selectively energizing the heating resistor when required.

The switch means of the heating circuit comprise a first and a second switch in series to the heating resistor, the heating resistor being interposed between the first and second switches.

A monitoring circuit arrangement is provided, comprising a first resistor in shunt to the heating resistor and having a resistance substantially higher than that of the heating resistor, and a pull-up network connected between a first terminal of the heating resistor and one of the voltage distribution lines, the control unit being configured for receiving a voltage corresponding to an electric potential at a second terminal of the heating resistor.

The appliance may further comprise a main switch controlled by the control unit for selectively allowing the powering of the appliance, and the heating circuit may be connected to the voltage supply lines upstream or downstream the main switch with respect to an AC voltage plug of the appliance.

The main switch may be a switch switchable to close only conditioned to the fact that the control unit detects that an appliance door is closed.

The pull-up network may be connected to the voltage distribution lines either downstream or upstream the main switch.

The monitoring unit may further be configured for detecting a value of the voltage distributed by the voltage distribution lines and for comparing the detected value of the voltage distributed by the voltage distribution lines with the received voltage corresponding to the electric potential at the second terminal of the heating resistor.

In particular, the monitoring unit may be configured for dynamically deriving, during the operation of the appliance, from the detected value of the voltage distributed by the voltage distribution lines at least one reference electric potential to be compared with the received voltage corresponding to the electric potential at the second terminal of the heating resistor.

Said reference electric potential derived in a dynamic way is preferably calculated periodically.

BRIEF DESCRIPTION OF THE DRAWINGS

These and other features and advantages of the present invention will appear more clearly by reading the following detailed description of an embodiment thereof, provided merely by way of non-limiting example, description that will be conducted making reference, for better intelligibility, to the attached drawings, wherein.

DETAILED DESCRIPTION OF EXAMPLE EMBODIMENTS

Figure 1:
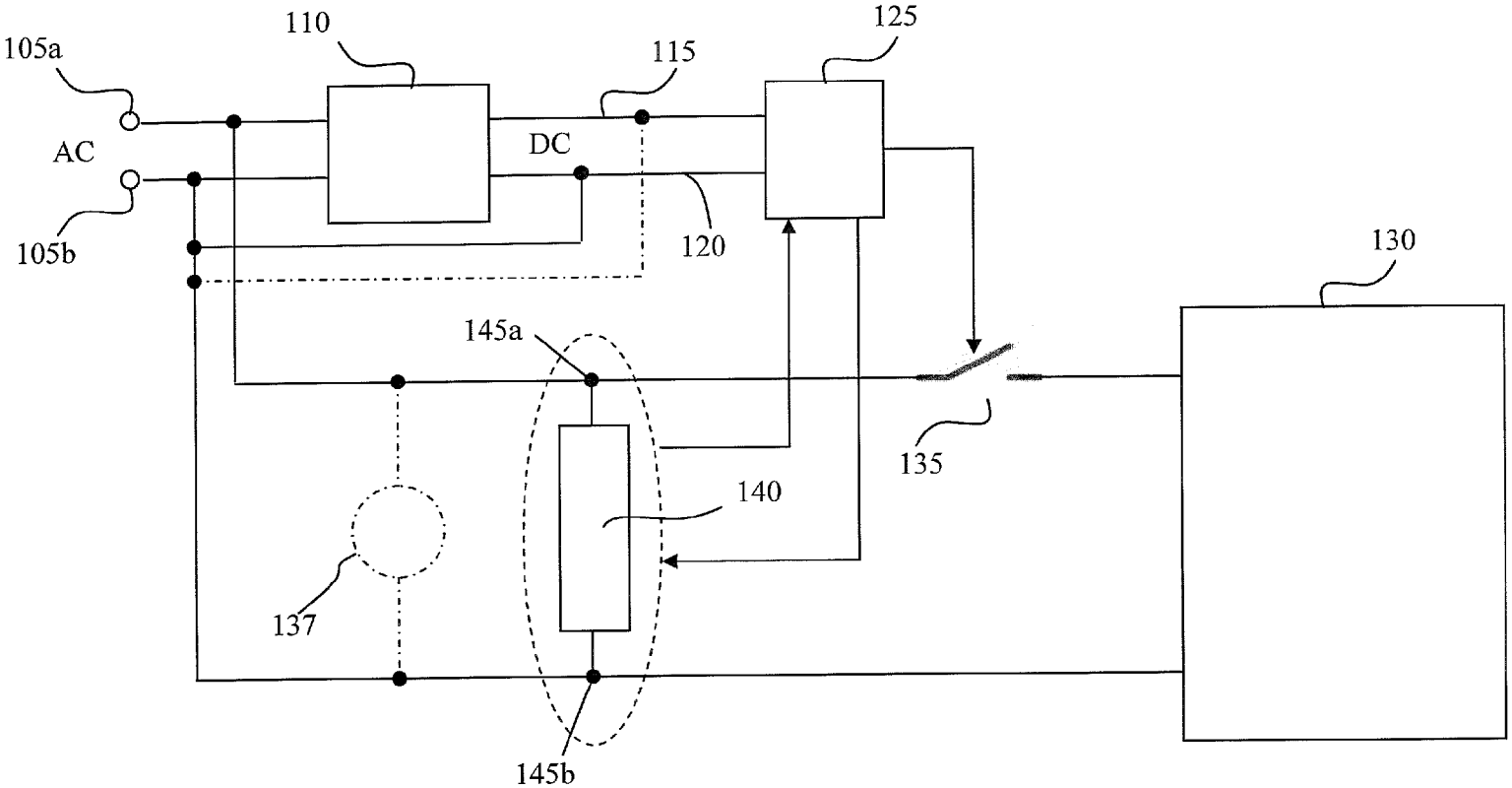
FIG. 1 is a schematic block diagram of part of an electric circuitry of a household appliance, for example a laundry washer, with a heating circuit arrangement according to an embodiment of the present invention.

Making reference to the drawings, FIG. 1 depicts a schematic block diagram of part of an electric circuitry of a household appliance, for example, but not limitatively, a laundry washer. Reference numerals 105*a* and 105*b* denote two terminals which, in use, are plugged into an electricity main socket (not shown), for receiving the AC voltage (for example, terminal 105*a* is connected to a plug pin that is plugged to the AC socket port of the line voltage and terminal 105*b* is connected to a plug pin that is plugged to the AC socket port of the neutral); the AC voltage may for example be of 220V at 50 Hz nominal, or of 110V at 60 Hz nominal (other values are possible, depending on the standard adopted in a particular country).

The AC voltage is fed to a voltage transformer and rectifying circuit 110, for generating one or more DC voltage values, distributed by DC voltage distribution lines 115 and 120, for example a 5V voltage for supplying a logic control unit 125, including for example a microprocessor or a microcontroller, controlling the operation of the appliance. Either one or the other of the DC voltage distribution lines 115 and 120 may be connected to the neutral (terminal 105*b*).

Block 130 is intended to schematically represent all those parts of the appliance that are supplied by the AC voltage; such parts include for example the electric motor for rotating the laundry drum, the drain pump for discharging the washing/rinsing fluid, and the electrovalve(s) for intaking water from a water main. The AC line voltage received at the terminal 105*a* is selectively fed to the parts schematized by block 130 through a main switch 135 (which may for example be the so-called "door-lock" switch), controlled by the control unit 125, which is closed only on condition that the appliance door (not depicted in the drawings) is correctly closed. In this way, it is ensured that, for safety purposes, the appliance cannot be started when the door is open, so as to prevent possible injuries. In alternative embodiments of the invention, some of the parts schematized as included in block 130 downstream the main switch 135 may be moved upstream it; this may for example be the case of the drain pump 137, shown in phantom in FIG. 1, which, when placed upstream the main switch 135, can be operated for safety purposes to discharge the liquid present in the machine even in case the door is open.

A heating circuit with monitoring arrangement 140 is provided, for heating the washing liquid for washing and/or rinse laundry. According to an embodiment of the present invention, the heating circuit 140 is connected to the AC voltage terminals 105*a*, 105*b* upstream the main switch 135, i.e. one terminal 145*a* of the heating circuit 140 is connected to a conductor connected to the terminal 105*a* and carrying the line voltage, and the other terminal 145*b* is connected to the neutral terminal 105*b*.

The operation of the heating circuit 140 is controlled by the control unit 125, which in addition monitors (through the monitoring arrangement) the heating circuit 140 for detecting possible faults, as will be described in greater detail in the following.

Figure 2:
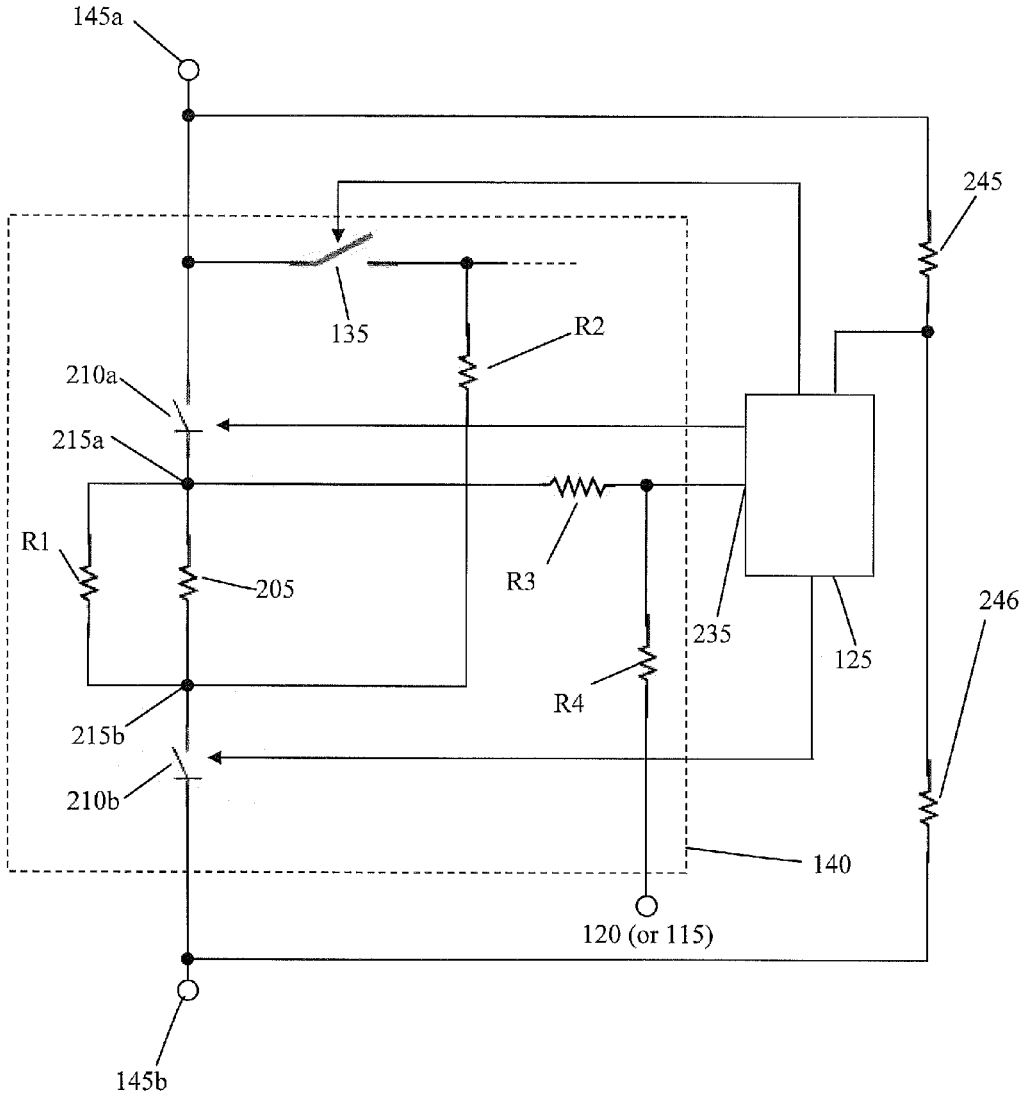
FIG. 2 shows in greater detail the heating circuit arrangement of FIG. 1.

FIG. 2 provides a more detailed view of the heating circuit 140 according to an embodiment of the present invention. The heating circuit 140 of the exemplary embodiment here considered comprises at least one heating resistor 205, connected in series with two switches 210*a* and 210*b* (a high-side switch 210*a* and a low-side switch 210*b*) between the voltage line connected to line voltage terminal 105*a* and, respectively, the neutral line connected to neutral terminal 105*b*. The heating resistor 205 is the element that, when energized, heats the washing liquid and/or the drying air flow. The switches 210*a* and 210*b* are for example relays, particularly monostable or alternatively bistable relays, which controlled, similarly to the door-lock switch 135, by the control unit 140. One or two thermofuses may be provided at either one or both of the two terminals 215*a* and 215*b* of the heating resistor 205, for protecting the heating resistor 205 against burning in case of overheating (in such a case, one or both of the thermofuses blow and thereby disconnect the heating resistor from the heating circuit); however, as will result clear from the following, the provision of the thermofuses is not strictly necessary.

It is clear from FIG. 2 that the heating resistor 205 is interposed between the two switches 210*a* and 210*b* with a first node on a high side of heating resistor 205 in electrical contact with a low side terminal of switch 210*a*, and a second node on a low side of heating resistor 205 in electrical contact with a high side terminal of switch 210*b*.

A first resistor R1 is connected in shunt between the terminals 215*a* and 215*b* of the heating resistor 205 that are connected to the switches 210*a* and 210*b*, respectively; the first resistor R1 has a resistance value (e.g., approximately 150 KOhms) substantially higher than the typical resistance of the heating resistor 205 (thus, when the heating resistor 205 functions properly, the overall resistance of the shunt connection essentially coincides with the resistance of the heating resistor 205). A second resistor R2 is connected between terminal 215*b* and the voltage line downstream the main switch 135. The control unit 125 is arranged to sense the voltage at the terminal 215*a* through a voltage divider circuit comprising a third resistor R3 connected between terminal 215*a* and a measuring input 235 of the control unit 125, and a fourth resistor R4 connected between the measuring input 235 and one of the two DC voltage distribution lines 115 and 120, namely to the DC voltage distribution line that is connected to the neutral. The control unit 125 is further arranged to sense the line voltage received at terminal 105*a*, for example through a resistive voltage partition network which may include one or two resistors 245, 246 connected between the line voltage and the neutral.

The heating circuit arrangement described in the foregoing operates as follows.

When the appliance is plugged into the main voltage socket, the control unit 125 is energized.

When the user inputs an appliance start command, conditioned to the fact that the door is assessed to be closed, the control unit commands the main switch 135 to close, thereby energizing the machine parts schematized in block 130.

In order to heat the washing fluid and/or the drying air flow, the control unit 125 commands the switches 210*a* and 210*b* to close. In this way, the heating resistor 205 is energized. Also in this case, the control unit 125 commands the switches 210*a* and 210*b* to close only conditioned to the fact that the appliance door is assessed to be closed.

The control unit 125, thanks to the circuit arrangement shown, is able to monitor the correct operation of the heating circuit and to detect possible faults thereof. To do this, the control unit 125 may be configured (i.e. programmed) to perform a check sequence of the heating circuit for detecting possible failures of the components thereof.

The control unit 125 periodically senses the line voltage value via the voltage partition network 245, 246 (e.g., every 20-80 milliseconds).

From the sensed value of the line voltage, the control unit 125 dynamically calculates and periodically updates (e.g., every 20-80 milliseconds) threshold values; such threshold values are dimensionless quantities which are calculated using a mathematical function implemented by the control unit 125. Similarly, the control unit 125 derives, from the voltage received at the measuring input 235, a dimensionless quantity that is compared to the dimensionless threshold values calculated on the basis of the detected line voltage. Based on the outcome of the comparison, the control unit 125 is capable of detecting faults in the heating circuit arrangement. It is pointed out that the threshold values changes as the line voltage change: thanks to this, account is taken of the actual value of the line voltage, which as known may differ from country to country, and is also subject to fluctuations in time. This makes the detection of the possible fault conditions more accurate and reliable.

The table below (Table 1) provides an indication of how the voltage sensed at the measuring input 235, and thus the dimensionless value calculated by the control unit 125, changes depending on the status of the heating circuit arrangement and in case of different fault conditions. The values in Table 1 shown underlined are indicative of fault conditions.

TABLE 1

| Door lock | Switch 210a | Switch 210b | Sensed value | | | | | |
|---|---|---|---|---|---|---|---|---|
| open | open | open | 0 | 0 | 0 | 0 | 0 | 202 |
| closed | open | open | 170 | <150 | <170 | 3 | <170 | 202 |
| closed | open | closed | 3 | 0 | <170 | 3 | 3 | 202 |
| closed | closed | closed | 202 | 202 | 202 | 202 | 3 | 202 |
| | | | No faults | heating resistor open | Switch 210b glued open OR fault of driving circuit | Switch 210b glued closed | Switch 210a glued open or fault of driving circuit | Switch 210a glued closed |

When the control unit 125 commands the main switch 135 and the other two switches 210*a* and 210*b* to be in the open condition (first row of Table 1), the voltage sensed by the control unit 125 at the input 235 should (in case of no faults) be low, close to earth (the third and fourth resistors R3 and R4 pull the terminal 215*a* to ground); in Table 1, the dimensionless value corresponding to an absence of faults is 0. A detected high value (corresponding to the value of the line voltage) of the voltage at the input 235 (and thus a high value of the dimensionless value derived therefrom) is thus indicative of the fact that the switch 210*a* does not operate properly and is blocked closed ("glued closed").

When the control unit 125 commands the door lock switch 135 to close, but keeping the other two switches 210*a* and 210*b* open, so as to keep the heating resistor 205 de-energized (second row in Table 1), the voltage sensed at the input 235 should, in case of no faults, be relatively high but less than the value of the line voltage: in fact, in this condition a resistive path should exist that, from the line connected to the line voltage terminal 105*a*, passes through the main switch 135, the second resistor R2, the shunt of the heating resistor 205 and the first resistor R1, the third resistor R3, the fourth resistor R4 and reaches the neutral. In Table 1, the dimensionless value corresponding to no faults is 170. As shown in Table 1, based on the value of the voltage sensed at the input 235, the control unit 125 is capable of detecting and discriminating three possible faults:

a) a relatively high value (150 or less in Table 1), but sufficiently lower than the value (170) corresponding to the no-fault condition is indicative of the fact that the heating resistor 205 is "open", i.e. non-conductive; in fact, in this case the resistance value of the shunt connection between the heating resistor 205 and the first resistor R1 essentially coincides with the resistance of the first resistor R1, which is substantially higher than the resistance of the heating resistor 205. This type of fault may depend on a malfunctioning of one or both of the thermofuses which may be provided at the terminals of the heating resistor 205, or a problem of the heating resistor 205.

b) a very low value (3 in Table 1), close to ground, is indicative of the fact that the switch 210*b* is blocked closed ("glued closed"); in fact, in this condition the terminal 215*b* is short-circuit to the neutral, and thus the voltage at the terminal 215*a* is low.

c) a high value, corresponding to the line voltage (202 in Table 1) is indicative of the fact that the switch 210*a* is blocked closed ("glued closed"); in fact, in this condition the terminal 215*a* is short-circuited to the line voltage.

When the control unit 125 commands the main switch 135 to close, the switch 210*a* to open and the switch 210*b* to close (third row in Table 1), a no-fault condition correspond to a very low value sensed at the input 235 (corresponding to the dimensionless value 3 in Table 1); indeed, in this condition the terminal 215*b* is short-circuited to the neutral, and thus the voltage at the terminal 215*a* is low. As shown in Table 1, based on the value of the voltage sensed at the input 235, the control unit 125 is capable of detecting and discriminating two possible faults:

d) a first high voltage value (170 or less as indicated in Table 1) means that the switch 210*b* is "glued open", or that there is a fault in the driving output of the control unit that drives the switch 210*b*.

e) a second high value, higher than the first high value and corresponding to the line voltage (202 in Table 1) is indicative of the fact that the switch 210*a* is blocked closed ("glued closed"); in fact, in this condition the terminal 215*a* is short-circuited to the line voltage.

When, finally, the control unit 125 commands all the switches 135, 210*a* and 210*b* to close (fourth row in Table 1), a no-fault condition corresponds to a high voltage value sensed at the input 235; in fact, in this condition the terminal 215*a* should be short-circuited to the line voltage. A very low value (close to ground) is in this case indicative of the fact that the switch 210*a* is "glued open" (or that there is a fault in the driving output of the control unit that drives the switch 210*a*). In fact, in this condition the terminal 215*b* is short-circuit to the neutral, and thus the voltage at the terminal 215*a* is low.

The provision of the two switches 210*a* and 210*b* in the heating circuit 140, one upstream and the other downstream of the heating resistor 205, makes the heating circuit 140 safer: also in case of faults in the heating resistor, by switching open the two switches 210*a* and 210*b* the appliance can be put in conditions of safety for the user without having to open the door, and possibly without having to halt the machine operation.

In particular, the heating circuit described allows to discriminate whether a fault consists in the heating resistor being disconnected or in current leakages in the heating resistor; the first fault is not dangerous for the user's safety: it simply means that the washing liquid (or the drying air flow) cannot be heated; the second fault is instead potentially dangerous, because of dispersion currents. In both cases, the machine cycle needs not be halted: the control unit 125 commands the two switches 210*a* and 210*b* to open and leaves the appliance to terminate the cycle.

Thus, thanks to the circuit arrangement according to the described embodiment, it is possible to detect not only a failure of the heating resistor 205 consisting in a short-circuit to the neutral, but also to detect if a failure involving the heating resistor is risky or acceptable.

An advantage of the described solution is that the heating circuit, inclusive the elements necessary to properly monitor the heating circuit for possible faults, substantially does not involve stand-by power consumption. In fact, when the appliance is not operating, the main switch 135 and the two switches 210*a* and 210*b* are open, thus no conductive path exists between the line voltage and the neutral (also the resistive path including resistors R2, R1 in parallel to 205, R3 and R4 is disconnected from the line voltage); the only consumption is given by the resistive partition network 245, 246. However, nothing prevents from connecting the second resistor R2 upstream the main switch 135, or, vice versa, connecting the heating circuit (heating resistor 205 and switches 210*a* and 210*b*) downstream the main switch 135 and the second resistor R2 upstream, or moving all circuit 140 downstream the main switch 135.

Clearly, those skilled in the art will be able to make several changes to the described invention embodiment, without departing from the scope of the invention defined in the appended claims.

For example, the second resistor R2 may be connected to the terminal 215*a* of the heating resistor 205, and the measuring input 235 of the control unit 125 may be coupled to the terminal 215*b*.

The invention claimed is:

1. A washing and/or drying appliance, comprising a heating circuit for heating a washing liquid and/or a drying air flow, the heating circuit being connected to voltage distribution lines distributing power inside the appliance and comprising at least one heating resistor and switch means controlled by an appliance control unit for selectively energizing the heating resistor when required, wherein:

the switch means of the heating circuit comprise a first switch and a second switch, the heating resistor being interposed between the first and second switches with a first node on a high side of said heating resistor in electrical contact with a low side terminal of said first switch, and a second node on a low side of said heating resistor being in electrical contact with a high side terminal of said second switch; and a monitoring circuit arrangement is provided, said monitoring circuit arrangement comprising a first resistor in shunt to the heating resistor and having a resistance substantially higher than that of the heating resistor, and a pull-up network connected between a first terminal of the heating resistor and one of the voltage distribution lines, the control unit being configured for receiving a voltage corresponding to an electric potential at a second terminal of the heating resistor.

2. The appliance of claim 1, further comprising a main switch controlled by the control unit for selectively allowing the powering of the appliance, wherein the heating circuit is connected to the voltage supply lines upstream or downstream of the main switch with respect to an AC voltage plug of the appliance.

3. The appliance of claim 2, wherein said main switch is switchable to close only conditioned to the fact that the control unit detects that an appliance door is closed.

4. The appliance of claim 2, wherein said pull-up network is connected to said voltage distribution lines either downstream or upstream the main switch.

5. The appliance of claim 1, wherein the monitoring unit is further configured for detecting a value of the voltage distributed by the voltage distribution lines and for comparing the detected value of the voltage distributed by the voltage distribution lines with the received voltage corresponding to the electric potential at the second terminal of the heating resistor.

6. The appliance according to claim 5, in which the monitoring unit is configured for dynamically deriving, during the operation of the appliance, from the detected value of the voltage distributed by the voltage distribution lines, at least one reference electric potential to be compared with the received voltage corresponding to the electric potential at the second terminal of the heating resistor.

7. The appliance according to claim 6, in which said reference electric potential derived in a dynamic way is calculated periodically.

8. The appliance of claim 3, wherein said pull-up network is connected to said voltage distribution lines either downstream or upstream the main switch.

9. The appliance of claim 2, wherein the monitoring unit is further configured for detecting a value of the voltage distributed by the voltage distribution lines and for comparing the detected value of the voltage distributed by the voltage distribution lines with the received voltage corresponding to the electric potential at the second terminal of the heating resistor.

10. The appliance of claim 3, wherein the monitoring unit is further configured for detecting a value of the voltage distributed by the voltage distribution lines and for comparing the detected value of the voltage distributed by the voltage distribution lines with the received voltage corresponding to the electric potential at the second terminal of the heating resistor.

11. The appliance of claim 4, wherein the monitoring unit is further configured for detecting a value of the voltage distributed by the voltage distribution lines and for comparing the detected value of the voltage distributed by the voltage distribution lines with the received voltage corresponding to the electric potential at the second terminal of the heating resistor.

12. The appliance of claim 8, wherein the monitoring unit is further configured for detecting a value of the voltage distributed by the voltage distribution lines and for comparing the detected value of the voltage distributed by the voltage distribution lines with the received voltage corresponding to the electric potential at the second terminal of the heating resistor.

* * * * *